United States Patent [19]

Suzuki

[11] Patent Number: 4,848,523

[45] Date of Patent: Jul. 18, 1989

[54] SLIDING EXHAUST BRAKE SYSTEM

[75] Inventor: Ryoichi Suzuki, Mishima, Japan

[73] Assignee: Usui Kokusai Sangyo Kaisha Ltd., Shizuoka, Japan

[21] Appl. No.: 247,032

[22] Filed: Sep. 20, 1988

[30] Foreign Application Priority Data

Dec. 23, 1987 [JP] Japan ..... 62-325917

[51] Int. Cl.[4] ..... F02D 9/36

[52] U.S. Cl. ..... 188/273; 123/323; 251/63.6

[58] Field of Search ..... 188/273, 287, 286; 123/323; 251/63.6, 331, 318, 324, 326, 327, 285; 137/338; 74/866, 867; 60/602

[56] References Cited

U.S. PATENT DOCUMENTS 4,205,704 6/1980 Benson ..... 188/273 X
4,408,627 10/1983 Harris ..... 188/273 X
4,553,648 11/1985 Suzuki et al. ..... 188/273
4,685,544 8/1987 Takigawa et al. ..... 188/273
4,751,987 6/1988 Takigawa et al. ..... 188/273
4,773,440 9/1988 Yanagawa et al. ..... 188/273 X

*Primary Examiner*—Douglas C. Butler
*Attorney, Agent, or Firm*—Anthony J. Casella; Gerald E. Hespos

[57] ABSTRACT

A sliding exhaust brake system installed on a large-sized vehicle. The system comprises a reciprocating piston rod, an auxiliary valve member fixed to the rod, and a main valve member. The auxiliary valve member makes a sliding contact with the bottom wall of the main valve member. At least one holes extends through the auxiliary valve member. The main valve member is provided with plural exhaust pressure-adjusting holes. When the exhaust passage of the brake system is closed off, the auxiliary valve member closes all the exhaust pressure-adjusting holes.

5 Claims, 2 Drawing Sheets

SLIDING EXHAUST BRAKE SYSTEM

BACKGROUND OF THE INVENTION

1. Field of the Invention

The present invention relates to improvements in the structure of the valve mechanism of a sliding exhaust brake system which is installed in the exhaust pipe of a large-sized vehicle, such as a truck or bus, and acts to close off the exhaust passage for the exhaust gas flowing through the exhaust pipe when the vehicle is going down steep hills, thereby braking the vehicle.

2. Description of the Prior Art

A known valve mechanism of this kind is disclosed in U.S. Pat. No. 4,205,704. The structure of this valve mechanism is shown in FIG. 6, where a main gate consists of a valve member 23 mounted in a valve working space formed inside the housing of the body of an exhaust brake. The valve member 23 is provided with a single exhaust pressure-adjusting hole 24. An air cylinder system includes a piston rod 26. A relief gate 25 is mounted at the front end of the piston rod 26. A liner 27 makes a frictional contact with the surface of the main gate which is loosely mounted on the underside of the relief gate 25, to form an auxiliary valve member that is fitted to the main valve member at 28. When the exhaust passage is opened and closed, the piston rod 26 is pushed up and down, and the front end 26' of the piston rod and the wall surface 25' of the relief gate 25 collide with the side walls 29' and 29', respectively, of the main gate.

In the conventional structure of the auxiliary valve member, the size of the main gate determined according to a limited space makes it impossible to render the exhaust pressure-adjusting hole large. Therefore, the exhaust pressure cannot be lowered sufficiently before the passage is opened. When the passage is opened and closed, the piston rod collides with the main gate as mentioned previously and so the mating portions wear away or cause play between them. As the passage is opened and closed repeatedly and frequently, the lifetime of the manufactured product is shortened. Hence, the structure cannot be employed for a long period.

SUMMARY OF THE INVENTION

It is an object of the invention to provide a sliding exhaust brake system which has exhaust pressure-adjusting holes capable of lowering the exhaust pressure sufficiently so as to perform its braking function smoothly and rapidly and which can be used for a long period without producing wear or play.

The above object is achieved in accordance with the teachings of the invention by a sliding exhaust brake system comprising: an exhaust passage having protruding walls at its both side ends, an exhaust pipe extending through the walls; a valve working space formed in the housing of the body of an exhaust brake and extending substantially at right angles to the exhaust passage; a main valve member capable of reciprocating in the valve working space and having exhaust pressure-adjusting holes extending through the main valve member, the main valve member being mounted in the housing, the main valve member taking the form of a flat sheet; an air cylinder system mounted over the valve working space and having a diaphragm; a piston rod extending through the diaphragm; and auxiliary valve member fixed to the front end of the piston rod and capable of making a frictional contact with the bottom wall of the main valve member, the auxiliary valve member being provided with at least one hole extending therethrough; a plurality of exhaust pressure-adjusting holes formed in the bottom wall of the main valve member. When the piston rod is moved in one direction, the auxiliary valve member closes the exhaust pressure-adjusting holes and the piston rod causes the main valve member to close off the exhaust passage. When the piston rod is moved in the opposite direction, the auxiliary valve member opens all the exhaust pressure-adjusting holes and pushes the main valve member to cause it to open the exhaust passage.

In the novel sliding exhaust brake system, the plural exhaust pressure-adjusting holes, the auxiliary valve member fixed to the front end of the piston rod and capable of moving with the rod, and the at least one hole formed in the auxiliary valve member and positioned in the aforementioned relation to the exhaust pressure-adjusting holes enable the exhaust pressure to be sufficiently lowered according to the number of the exhaust pressure-adjusting holes and the number of the holes extending through the auxiliary valve member in spite of the size of the main valve member determined according to a limited space. Therefore, the braking function can be performed smoothly and rapidly. In addition, it is unlikely that mating components of the valve mechanism wear away or produce play between them. The inventive system can be used for a long period and is quite useful in many respects.

Other objects and features of the invention will appear in the course of description thereof which follows.

DETAILED DESCRIPTION OF THE PREFERRED EMBODIMENTS

Figure 1:
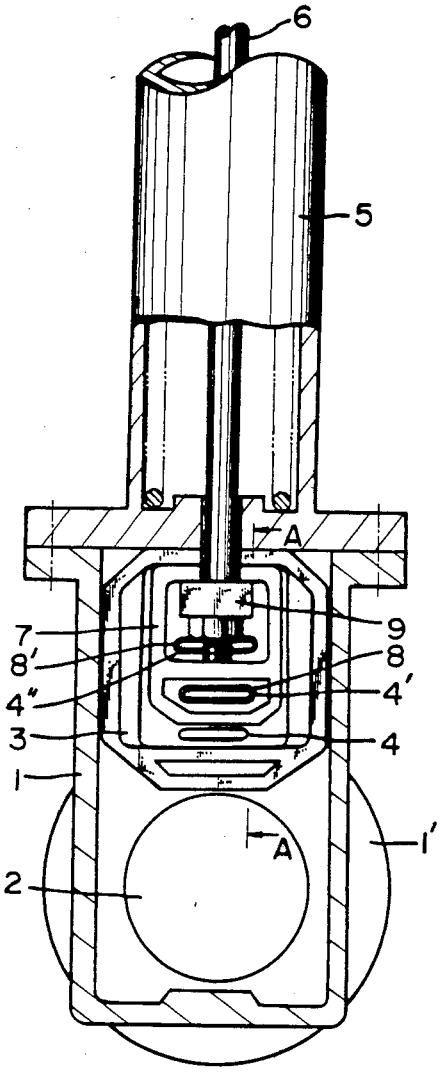
FIG. 1 is a partially cutaway plan view of a sliding exhaust brake system according to the invention.

Referring to FIGS. 1–5, the body of each sliding exhaust brake system according to the invention comprises a housing 1 provided with a valve working space in which a valve member 3 in the form of a flat sheet reciprocates. An exhaust passage 2 has protruding walls 1' at its both side ends. An exhaust pipe (not shown) extends through the walls 1' and is in communication with the exhaust passage 2. The valve working space extends substantially at right angles to the exhaust passage 2. The valve member 3 mounted in the valve working space inside the housing is provided with a plurality of exhaust pressure-adjusting holes 4, 4', 4', etc. extending through its bottom wall. An air cylinder system 5 is mounted over the valve working space and has a diaphragm through which a piston rod 6 extends. The valve member 3 engages with the piston rod 6 near the front end of the rod 6.

An auxiliary valve member 7 is mounted inside the valve member 3 and slightly spaced from the valve member 3. The auxiliary valve member 7 is connected to the front end of the piston rod 6 via a block member 9 such that when the piston rod 6 is pushed forward by the pressure of the exhaust gas, the auxiliary valve member 7 can make intimate contact with the valve member 3. At least one hole (8, 8', and so on) extends through the auxiliary valve member 7 and is located in such a way when the passage 2 is closed off, the exhaust pressure-adjusting holes 4 4', 4'', etc. in the valve member 3 are closed, and that when the passage 2 is opened, the hole or holes (8, 8', etc.) are in communication with the pressure-adjusting holes, 4, 4', 4'', etc. The auxiliary valve member 7 makes a frictional contact with the valve members 3.

If desired, the auxiliary valve member on the valve members 3 is designed to consist of a plurality of members placed on top of each other. The members are formed with holes (8, 8', etc.) extending through them. The holes (8, 8', etc.) are located in the manner described above. That is, when the passage 2 is closed off, the exhaust pressure-adjusting holes are closed. When the passage 2 is opened, these holes (8, 8', etc.) are in communication with the pressure-adjusting holes.

Figure 4:
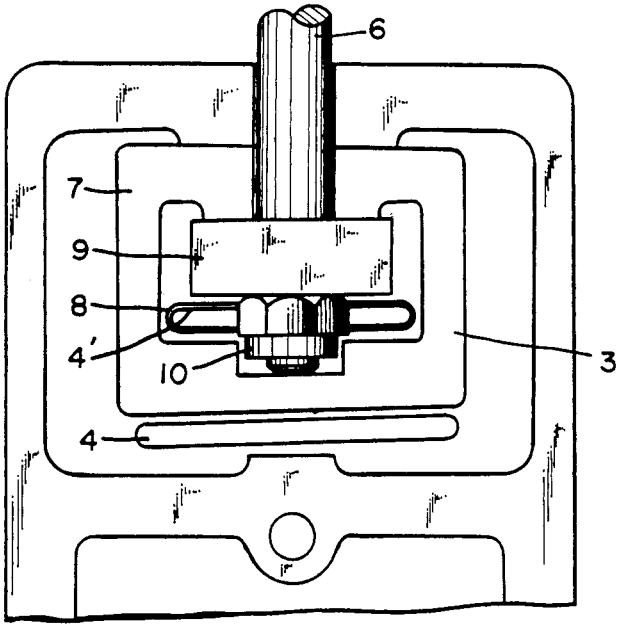
FIGS. 4 and 5 are partially cutaway enlarged views of main portions of other sliding exhaust brake systems according to the invention.

As shown in FIG. 4, a nut 10 may be screwed to the front end of the piston rod 6. The contour of the auxiliary valve member 7 may be made to substantially conform to the contour of the front end portion of the piston rod 6 including the nut 10 and the block member 9.

Figure 5:
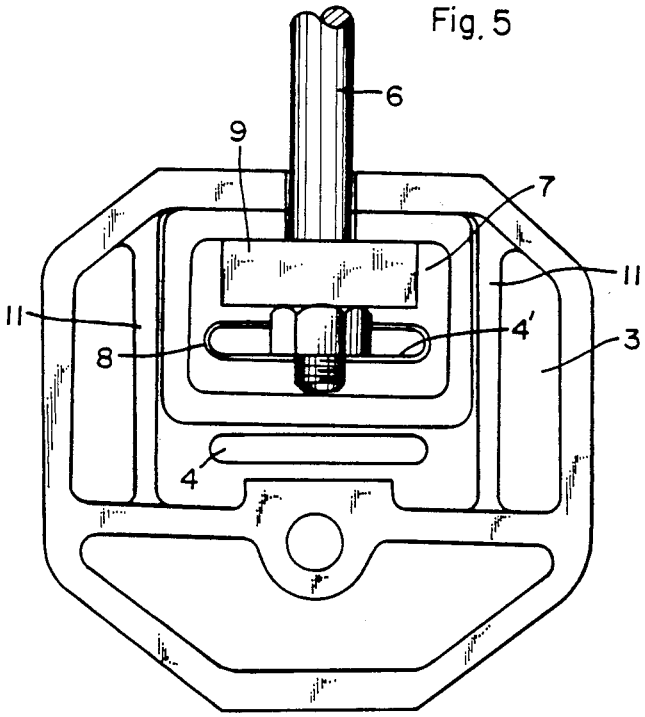
Figure 6:
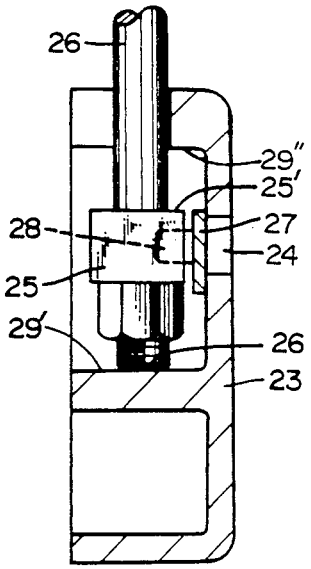
Fig. 6 PRIOR ART
FIG. 6 is an enlarged cross section of the prior art exhaust brake system.

As shown in FIG. 5, the valve member 3 may be provided with parallel ribs 11 which are spaced from each other by a distance substantially equal to the width of the auxiliary valve member 7. The auxiliary valve member 7 is disposed between the ribs 11 and fixed to the stationary part of the piston rod 6 to prevent the member 7 from moving back and forth. Thus, the piston rod is prevented from becoming damaged. Hence, the durability of the system is enhanced.

Figure 2:
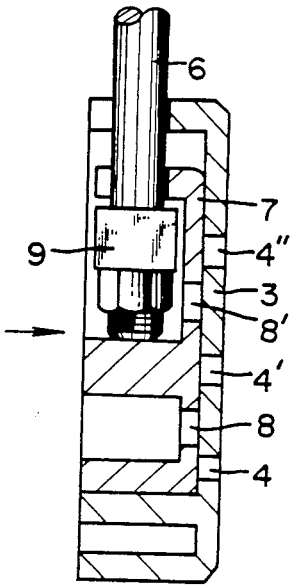
FIG. 2 is an enlarged cross section taken on line A—A of FIG. 1, and in which exhaust pressure-adjusting holes are closed.
Figure 3:
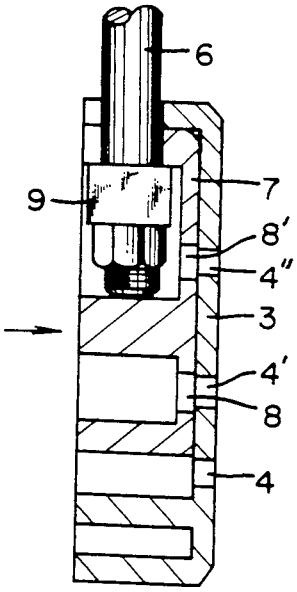
FIG. 3 is a cross section similar to FIG. 2, but in which the holes are open.

Since the system is constructed as described above, when the valve member 3 closes off the passage, the auxiliary valve member 7 makes a sliding movement on the surface of the valve member 3, closing the exhaust pressure-adjusting holes 4, 4', 4'', etc. as shown in FIG. 2. The front end of the auxiliary valve member 7 is forced in one direction and pressed against the valve member 3, thus closing off the passage. When the passage is opened, the auxiliary valve member 7 opens the exhaust pressure-adjusting holes 4, 4', 4'', etc. as shown in FIG. 3. In this state, the wall of the auxiliary valve member 7 which is on the side of the block member 9 moves the valve member 3 in the opposite direction.

In this way, the holes 8, 8', etc. extending through the auxiliary valve member 7 are brought into and out of register with the exhaust pressure-adjusting holes 4, 4', 4'', etc. The valve member 3 is connected to the front end of the piston rod 6 with a slight clearance therebetween such that the valve member 3 can be moved with the piston rod by its whole frictional surface. Thus the passage is opened and closed by the valve member 3.

What is claimed is:

1. A sliding exhaust brake system comprising:

an exhaust passage;

a valve housing with a valve working space formed in the housing and extending substantially at right angles to the exhaust passage;

a main valve member having a planar bottom wall, a plurality of exhaust pressure-adjusting holes extending through the bottom wall of the main valve member, the main valve member being mounted in the valve working space and being movable from a first position where the bottom wall substantially closes the exhaust passage to a second position for opening the exhaust passage;

a cylinder system mounted adjacent the valve working space;

a piston rod mounted for reciprocating movement in the cylinder system, said piston rod having a front end extending into the valve working space;

an auxiliary valve member mounted to the front end of the piston rod and being generally parallel to the bottom wall of the main valve member and generally adjacent thereto, the auxiliary valve member being provided with at least one hole extending therethrough, said at least one hole being disposed to be registered with at least one of said exhaust pressure-adjusting holes in the bottom wall of the main valve member in a first position of said auxiliary valve member relative to said main valve member, said auxiliary valve member being movable relative to said main valve members for closing the exhaust pressure-adjusting holes;

and wherein, when the piston rod is moved in one direction, the auxiliary valve member closes the exhaust pressure-adjusting holes and subsequently causes the main valve member to close off the exhaust passage and, when the piston rod is moved in the opposite direction, the auxiliary valve member opens all the exhaust pressure-adjusting holes and subsequently pushes the main valve member to open the exhaust passage.

2. The sliding exhaust brake system of claim 1, further including a preventing means for preventing said auxiliary valve member from moving in directions transverse to the piston rod.

3. The sliding exhaust brake system of claim 2, wherein said preventing means comprises a contour formed in the auxiliary valve member which substantially conforms to the front end of the piston rod.

4. The sliding exhaust brake system of claim 2, wherein said preventing means consists of parallel ribs formed on the main valve member and spaced from each other by a distance substantially equal to the width of the auxiliary valve member.

5. The sliding exhaust brake system of claim 1, wherein the auxiliary valve member is connected to the front end of said piston rod via a block member.

* * * * *